US005914029A

United States Patent [19]

Verachtert, II

[11] Patent Number: 5,914,029

[45] Date of Patent: Jun. 22, 1999

[54] HIGH EFFICIENCY DESULFURIZATION PROCESS

[75] Inventor: Thomas A. Verachtert, II, Arlington Heights, Ill.

[73] Assignee: UOP LLC, Des Plaines, Ill.

[21] Appl. No.: 08/927,007

[22] Filed: Sep. 10, 1997

Related U.S. Application Data

[60] Provisional application No. 60/031,647, Nov. 22, 1996.

[51] Int. Cl.[6] ..... C10G 45/00

[52] U.S. Cl. ..... 208/212; 208/209; 208/107; 585/752; 585/910; 585/911

[58] Field of Search ..... 208/209, 212, 208/107; 585/752, 910, 911

[56] References Cited

U.S. PATENT DOCUMENTS

| | | | |
|---|---|---|---|
| 2,840,513 | 6/1958 | Nathan | 208/209 |
| 3,003,953 | 10/1961 | Evans | 208/254 |
| 3,053,758 | 9/1962 | Georgs | 208/216 |
| 3,193,595 | 7/1965 | Kenton et al. | 585/402 |
| 3,356,608 | 12/1967 | Franklin | 208/212 |
| 3,382,168 | 5/1968 | Wood et al. | 208/264 |
| 3,394,074 | 7/1968 | Buchmann et al. | 208/111 |
| 3,475,322 | 10/1969 | Carson | 208/89 |
| 3,718,734 | 2/1973 | Christensen et al. | 423/228 |
| 3,850,743 | 11/1974 | Peiser et al. | 208/209 |

*Primary Examiner*—Walter D. Griffin
*Assistant Examiner*—Nadine Preisch
*Attorney, Agent, or Firm*—Thomas K. McBride; John F. Spears, Jr.

[57] ABSTRACT

Economies in capital cost and operation of a hydrocarbon refining unit for desulfurization of diesel fuel are provided by a heat exchange sequence which eliminates the need for a fired heater on the product fractionation zone. The feed to the fractionation zone is heat exchanged twice against both the effluent bottoms stream of the fractionation zone and the reaction zone effluent stream.

8 Claims, 1 Drawing Sheet

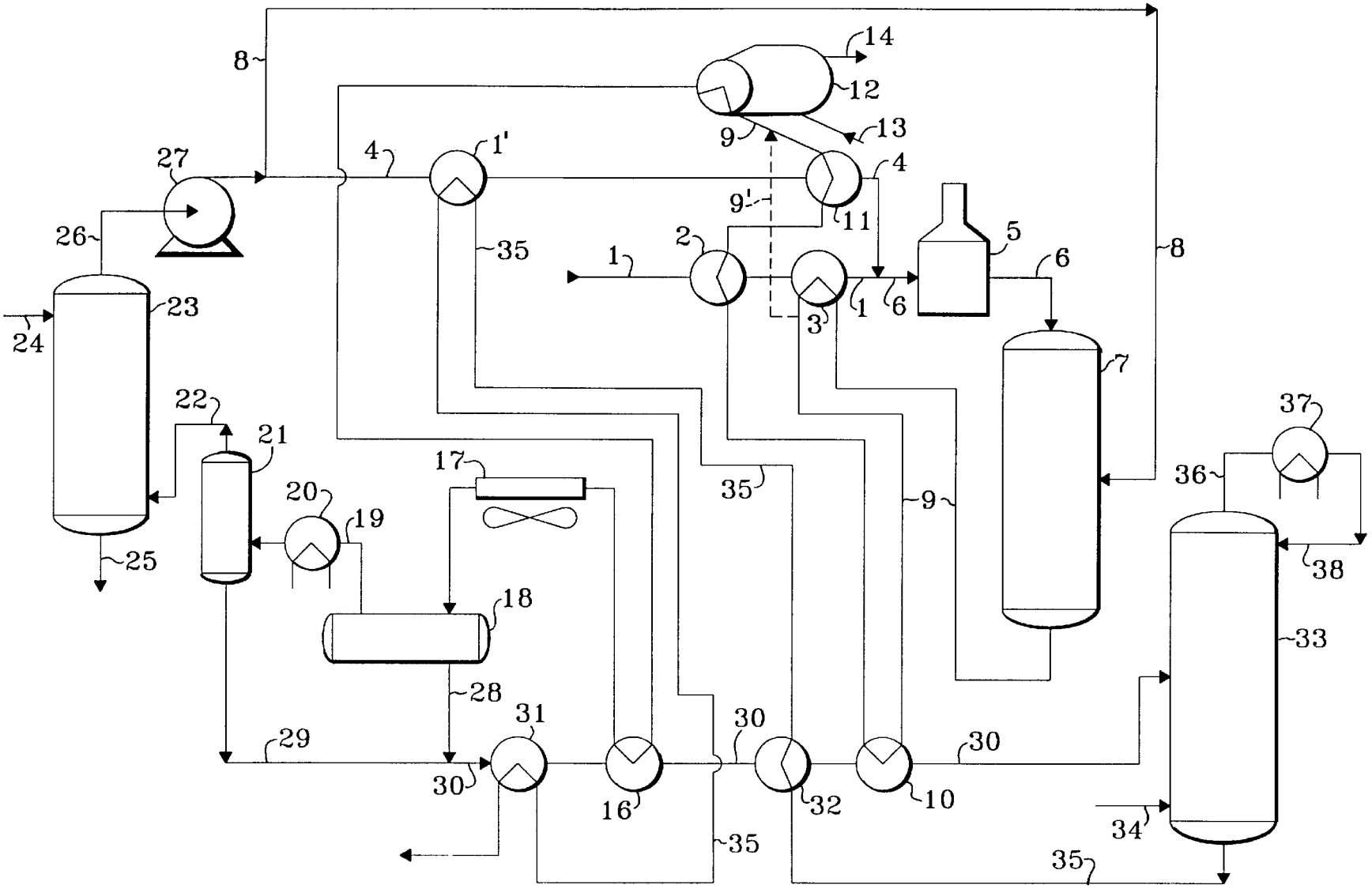
37
38
33
36
8
7
6
5
34
35
30
10
9
14
12
13
4
11
1
3
32
9'
2
16
31
1'
18
28
17
19
20
21
29
22
27
23
25
26
24

HIGH EFFICIENCY DESULFURIZATION PROCESS

This application is related to and claims the benefit of the filing date of provisional application 60/031,647 filed Nov. 22, 1996.

FIELD OF THE INVENTION

The invention relates to the design of hydrocarbon conversion units used in petroleum refineries. The invention more specifically relates to the design of hydrodesulfurization units used to remove sulfur from distillate boiling range hydrocarbon fractions. The invention is specifically directed to the use of indirect heat exchange within hydrodesulfurization units to recover heat and reduce the cost of operating the process.

RELATED ART

U.S. Pat. No. 3,475,322 issued to D. B. Carson illustrates several basic heat exchange techniques used to recover heat from the effluent of a reaction zone of a hydrocarbon conversion process.

U.S. Pat. 3,356,608 issued to F. C. Franklin illustrates a process flow for the desulfurization of a heavy distillate fraction wherein heat recovered from the reaction zone effluent stream is used to heat the feed stream charged into the product stripping column. Steam is charged to the bottom of this column to aid in the stripping of light materials from the product stream.

SUMMARY OF THE INVENTION

The invention is a hydrocarbon conversion process useful in such processes as the hydrotreating and hydrocracking of petroleum distillate fractions derived from crude oil by fractional distillation. The invention is characterized by the heat exchange steps employed in the process to recover and reuse heat from the reaction zone effluent stream. These steps simplify and reduce the cost of the process as by eliminating the need for a fired heater on the product fractionation column. A broad embodiment of the invention may be characterized as a hydrocarbon conversion process which comprises the steps of passing a feed stream having an initial boiling point above 150° C. into a reaction zone maintained at hydrocarbon conversion conditions and producing a mixed phased reaction zone effluent stream comprising hydrogen, light hydrocarbons and hydrocarbons boiling above 150° C.; cooling the reaction zone effluent stream by indirect heat exchange against the feed stream in a first heat exchanger; cooling the reaction zone effluent stream by indirect heat exchange against a first process stream in a second heat exchanger; cooling the reaction zone effluent stream by indirect heat exchange against the first process stream in a third heat exchanger; further cooling and partially condensing the reaction zone effluent stream and passing the reaction zone effluent stream into a vapor-liquid separation zone which produces the first process stream; and, passing the first process stream into an intermediate portion of a fractionation column operated at conditions effective to separate entering hydrocarbons into a net overhead stream comprising naphtha boiling range hydrocarbons and a net bottoms stream comprising diesel boiling range hydrocarbons and removing the net bottoms stream as a product stream.

BRIEF DESCRIPTION OF THE DRAWING

The drawing is a simplified process flow of a petroleum refinery process unit designed to desulfurize a gas oil feed stream of line 1 to produce a diesel boiling range product stream recovered from the bottom of stripping column 33.

DETAILED DESCRIPTION

The petroleum fractions recovered from crude oil almost without exception contain a sizable amount of contaminants which must be removed before these fractions meet commercial product and environmental standards. One of the chief means of removing these contaminants is by hydrotreating. Hydrotreating is also useful in upgrading the feed stream to many downstream conversion processes. For instance, hydrotreating a resid will improve it as the feed to an FCC unit. Hydrotreating can also be employed to reduce the level of catalyst poisons in the feed to a downstream unit. There has therefore developed an extensive body of art on the hydrotreating of the various crude oil fractions to remove sulfur and nitrogen compounds, saturate olefinic hydrocarbons and adjust the viscosity, boiling point range or other properties of the fractions. The economic optimization of these processes, as shown by the above cited references, has reached a high level of sophistication in such as areas as heat exchange to recover useful heat. Nevertheless it is always desirable to further reduce the amount of fuel which is consumed in a hydrotreating process, to reduce the amount of capital equipment needed to construct the process unit and to minimize the emissions from fired heaters. As used herein the term fired heater means an industrial furnace employed to heat a process stream in a refining unit by the combustion of a hydrocarbonaceous fuel.

It is the objective of the subject invention to provide a highly energy efficient hydrotreating process. It is a further objective of the invention to eliminate the need for a fired heater on the product fractionation zone of a desulfurization process. In the subject invention these objectives are met by a highly integrated heat exchange system which recovers sufficient heat from the reactor effluent and fractionation column bottoms stream effluents to eliminate the need for a fired feed heater on the feed stream to the fractionation column.

While the bulk of the description of the invention is in terms of a hydrodesulfurization process, the invention is not limited to this one preferred embodiment. The subject process can also be applied to hydrotreating intended to remove impurities other than sulfur, hydrotreating intended primarily for aromatics saturation, hydrocracking to reduce the average boiling point of the feed, and catalytic hydrodewaxing to produce lube oil base stocks.

The feed stream to the subject process is expected to normally comprise at least one heavy petroleum fraction produced in a petroleum refinery as by fractional distillation of crude oil. The feed may be a mixture of several fractions produced by different refinery units. These fractions and other typical feeds will normally have a boiling point range at least partially overlapping a range of about 315 to about 565° C. (600 and 1050° F.) and encompass straight run naphtha, straight run gas oils, vacuum or resid gas oils, diesel or jet fuel fractions, catalytic cracker or thermal cracker gas oils, etc. A hydrotreating process such as desulfurization will generate a product stream highly similar to the feed stream. A hydrocracking process will reduce the average molecular weight of the feed and produce one or more lighter product streams.

The Drawing illustrates the use of the subject method in a proposed commercial diesel hydrotreating unit. Referring now to the Drawing, a feedstream comprising a diesel boiling range fraction recovered from the atmospheric fractionation column of a petroleum refinery is fed into the process through line 1. This feedstream is heated in the indirect heat exchange means 2 and then in the indirect heat exchange means 3 before being admixed with a hydrogen-rich gas stream carried by line 4. The resulting admixture continues through line 6 into a fired heater 5 wherein it is raised to the desired inlet temperature for the downstream reaction zone. The effluent of the fired heater 5 flows through line 6 into the upper end of the reaction zone 7, which can comprise two or more individual vessels. As the desulfurization reactions and hydrogenation reactions which occur within the reaction zone 7 are highly exothermic, it is normally necessary to provide a means to moderate the temperature increase which occurs within the reaction zone. In the subject process this is performed by the injection of relatively cool "quench" gas from line 8 into an intermediate point in the reaction zone 7. This quench gas is admixed with the reactants passing through the reaction zone and the resulting mixed phase flow then continues through another bed of catalyst before exiting the reaction zone through line 9.

The reactions which occur within the reaction zone 7 when the feedstream and hydrogen are brought into contact with the desulfurization catalyst result in the production of hydrogen sulfide and to a lesser extent ammonia. Also produced is a small quantity of light hydrocarbons which augment the light hydrocarbons which are fed to the reaction zone as a portion of the recycle gas of line 4. The effluent of the reaction zone therefore comprises a very broad admixture of compounds including unconsumed hydrogen, unconverted feed hydrocarbons, recycled light hydrocarbons, (hydrocarbons which are normally gaseous at a temperature of 60° F. and one atmosphere pressure), by-product compounds including hydrogen sulfide and ammonia and product boiling range hydrocarbons. The diversity of the compounds which are found in the reaction zone effluent is also increased by the inexact nature of the fractional distillation used to produce the feedstream. This broad range of materials flows through line 9 to the heat exchange means 3 located upstream (relative to flow of the feed) of the fired heater wherein it is cooled before continuing through line 9 to the heat exchange means 10 where it is further cooled by indirect heat exchange against an internal process stream of the subject process. The reaction effluent stream then continues through line 9 to the heat exchanger 2 wherein it is employed to heat the feedstream. It then passes through line 9 into the heat exchanger 11 wherein additional heat is recovered by heating the recycle hydrogen gas stream of line 4.

Although a significant amount of heat has been recovered in these four indirect heat exchange steps, much useful heat still remains and is first employed in the steam generator to vaporize water fed through line 13. The produced steam is removed through line 14. The reaction zone effluent stream then continues through line 9 to the indirect heat exchange means 16 wherein it is used to heat the process stream of line 30. The reaction effluent stream is then passed into a cooler 17 wherein additional cooling and partial condensation of hydrocarbons occurs. The great bulk of the hydrocarbons have by this time been condensed due to the removal of significant amounts of heat evaporization and sensible heat from the reaction zone effluent stream. There is thereby formed a mixed phase stream which is charged to the vapor-liquid separation zone comprising vessels 18 and 21. The entering reaction effluent stream is separated into a liquid phase stream withdrawn through line 28 and a vapor phase stream removed through line 19. Not shown on the Drawing is the customary removal of a stream of liquid phase water from the vapor-liquid separation vessel 18. The vapor phase stream of line 19 is further cooled as by indirect heat exchange against water in the heat exchanger 20 with the resultant mixed phase stream passing into a second vapor-liquid separation vessel 21. An additional hydrocarbon liquid phase stream is removed from this separator through line 29 and is admixed with the liquid flowing through line 28 to form the process stream of line 30.

The liquid phase stream recovered from the separation zone comprising separators 18 and 21 is first passed through the heat exchanger 31 and is then passed through the heat exchanger 16. Both of these steps increase the temperature of this process stream. It is then passed through the heat exchanger 32 wherein it is further heated and is finally heated to a desired column inlet temperature by passage through the indirect heat exchange means 10 wherein it is heated by the reaction zone effluent stream. The process stream of line 30 is then passed into an intermediate point of the fractionation column 33. Column 33 is designed and operated at conditions to effect the separation of the entering compounds into net overhead and bottom streams. This separation is performed without the use of a fired heater on the feedstream to the column and is performed in conjunction with the addition of high pressure steam to the bottom of the fractionation column through line 34. No reboiling means is provided at the bottom of the column 33.

A net bottoms stream comprising the desired diesel fuel boiling range product is removed from the fractionation column 33 through line 35 and passed in sequence through the indirect heat exchange means 32, 1' and 31 before being removed from the process as the primary product stream. A vapor stream is removed from the top of the fractionation column 33 through line 36 and passed through the overhead condenser 37. This results in the formation of a two phase stream which is directed to an overhead receiver not shown. Portions of the liquid phase hydrocarbons collected in the overhead receiver are passed into the top of the column through line 38 as reflux and removed from the process through line 39 as a net overhead stream comprising naphtha boiling range product hydrocarbons.

The gas phase stream recovered from the second vapor-liquid separation vessel 21 is passed through line 22 into the gas scrubbing vessel 23. In this vessel it is contacted by a descending stream of liquid such as an aqueous amine solution fed to the upper portion of the scrubbing vessel 23 through line 24. This amine stream flows downward countercurrent to the rising gas and is removed as a hydrogen sulfide rich liquid stream withdrawn from the scrubbing vessel through line 25 and passed into a regeneration means. This produces a total recycle gas stream having a reduced content of hydrogen sulfide which is removed from the stripping vessel 23 through line 26 and pressurized in the recycle compressor 27. The total recycle gas is then divided into the quench gas stream of line 8 and the main recycle gas of line 4 which is heated in heat exchangers 1' and 11.

Line 9' of the drawing is an optional line described in more detail in the following example. It is employed when it is desired to bypass a portion of the material in line 9 around heat exchangers 10, 2 and 11. This is one means of adjusting the amount of heat added to the contents of line 30 and the amount of steam produced in steam generator 12.

Those familiar with the hydrotreating and hydrocarbon conversion arts will readily recognize that the subject drawing has been greatly simplified and that a number of needed pieces of equipment and systems are not shown on the Drawing. These include flow control systems, pressure, temperature, and composition control and monitoring systems, bypass systems around compressors and heat exchangers, vessel internals such as the internal structures of the reactor and fractionation columns, makeup hydrogen systems, water injection to control salt formation, water removal systems, etc.

One embodiment of the invention may accordingly be characterized as a hydrocarbon conversion process which comprises the steps of heating a feed stream having an initial boiling point above 150° C. in a fired heater, passing the heated feed stream into a reaction zone maintained at hydrocarbon conversion conditions and producing a mixed phased reaction zone effluent stream comprising hydrogen, light hydrocarbons and hydrocarbons boiling above 150° C.; cooling the reaction zone effluent stream by indirect heat exchange against the feed stream in a first heat exchanger located at a point located upstream of the fired heater; cooling the reaction zone effluent stream by indirect heat exchange against a liquid phase first process stream in a second heat exchanger; cooling the reaction zone effluent stream by indirect heat exchange against the feed stream in a third heat exchanger at a point located upstream of the fired heater; cooling the reaction zone effluent stream by indirect heat exchange against the first process stream in a fourth heat exchanger; further cooling and partially condensing the reaction zone effluent stream and passing the reaction zone effluent stream into a vapor-liquid separation zone which produces the first process stream; passing the first process stream into an intermediate portion of a fractionation column operated at conditions effective to separate the entering hydrocarbons into a net overhead stream comprising naphtha boiling range hydrocarbons and a net bottoms stream comprising diesel boiling range hydrocarbons; and, cooling the net bottoms stream by indirect heat exchange against the first process stream in a fifth heat exchanger located intermediate the second and fourth heat exchangers, and removing the net bottoms stream as a product stream.

These subject processes may be practiced using a wide variety of hydrocarbon conversion catalysts including hydrocracking and mild hydrocracking catalysts. As the preferred embodiment of the invention is the desulfurization of a heavy distillate such as diesel fuel, the preferred catalyst is a desulfurization catalyst. Such catalysts are available commercially from a number of different suppliers including UOP, Criterion Catalyst Company, and Akzo Nobel. The preferred catalyst comprise nickel and molybdenum, cobalt and molybdenum or nickel and tungsten supported on a porous inorganic oxide such as alumina. The catalyst may be in the form of a sphere or a cylindrical or polylobial extrudate. Optionally the catalyst may contain phosphorous. Additional information on suitable catalysts for the performance of the subject process may be obtained by reference to U.S. Pat. Nos. 5,514,274; 5,308,814; 5,368,722; 5,062,947; and, 4,990,243. The content of these U.S. patents is expressly incorporated herein for teaching as to the composition of a suitable catalyst. Catalysts suitable for use in a hydrodewaxing process are described in U.S. Pat. Nos. 5,332,490; 4,601,993 and 4,859,311.

The reaction zone of the subject process is operated at hydrocarbon conversion conditions which include a liquid hourly space velocity of about 0.3 to 4.0, a broad temperature range of about 285 (545° F.) to about 425 (822° F.) and an elevated pressure normally above about 3,450 kPa (500 psig). A pressure in the range of 4825–17235 (700–2500) psig is preferred. Hydrocarbon conversion conditions also include the presence of hydrogen to supply that used in the desired reactions and to maintain catalyst activity. A hydrogen circulation greater than 500 s.c.f. per barrel of feed is preferred. A broad range of hydrogen circulation is from 500 to 20,000 s.c.f./b.

The following example is based on the engineering design of a commercial refining unit which will soon be built. The design was completed based upon experience gained in the design and operation of many previously built units of a similar nature, computer models, pilot plant studies and generally accepted engineering tools and procedures and is expected to very accurately project the operation which will occur in the actual unit. The charge stock to the unit is a mixture of heavy kerosene and gas oil from the atmospheric column of the refinery plus some light coker gas oil. All data is based on start of run conditions. The hydrocarbon feed stream of line 1 enters heat exchanger 2 at a temperature of about 236° C. at a flow rate of 393,687 kg/hr and is heated to approximately 310° C. by the reaction zone effluent stream. It is then further heated to 357° by a second exchange against the reaction zone effluent in exchanger 3. The hydrocarbon feed stream is then admixed with the recycle gas stream of line 4 which has a temperature of about 257° C. and a flow rate of approximately 12,991 kg/hr. The resultant combined feed is heated to about 344° C. in the fired heater 5 and then passed into the reaction zone 7. A quench stream of recycle gas having a temperature of about 90° C. and a flow rate of approximately 9961 kg/hr is charged to an intermediate point in the reaction zone to cool the reactants.

The effluent of the reaction zone is a mixed phase stream having a temperature of about 364° C. This effluent is cooled in heat exchanger 3 to about 359°, and then a minor portion having a flow rate of 29,165 kg/hr is split off for control purposes. The major portion of the effluent is then cooled to about 334° in heat exchanger 10. In heat exchanger 2 the major portion of the reaction zone effluent is then cooled to approximately 284° C. by a second or "cold" indirect exchange against the hydrocarbon feed stream. The major portion of the reaction zone effluent is then used to heat the recycle gas stream in heat exchanger 11. This cools this portion of the effluent to about 279° C. The two portions of the effluent are then remixed and passed into a multistage steam generation zone. This steam generation reduces the temperature of the reaction zone effluent stream to about 229° C. A final cooling for heat recovery in exchanger 16 cools the effluent to about 197° C. It is then cooled against ambient air to about 55° C. and passed into a vapor-liquid separator 18. A liquid phase hydrocarbon stream of about 391,326 kg/hr is removed in line 28 and a vapor phase stream of about 25,283 kg/hr is removed via line 19. The vapor stream is cooled to about 40° C. using cooling water and passed into vapor-liquid separator 21. A hydrocarbon liquid stream of about 312 kg/hr is recovered via line 29. The uncondensed remainder of reaction zone effluent is passed through line 22 into an amine scrubbing unit as the recycle gas stream of the process. The gas is washed with an aqueous amine solution and then with water to remove entrained amine. This produces a total gas stream having a flow of about 20,564 kg/hr. Higher hydrogen content makeup gas is added at the rate of 2,388 kg/hr to produce the total recycle gas stream.

While in this example illustrating the preferred embodiment of the invention, a portion of the reaction zone effluent stream was bypassed around heat exchangers 10 and 11, this is not a requirement of the process. All of the effluent stream can, if desired, flow through each of these exchangers as a single undivided flow. Those skilled in the art will appreciate that the design of the unit may include means for temporarily bypassing a controlled portion of various streams around exchangers or other equipment for the purposes of process control and operational safety.

The preferred embodiment of the invention may accordingly be characterized as a hydrotreating process which comprises the steps of heating a feed stream having an initial boiling point above 150° C. in a fired heater, passing the heated feed stream into a reaction zone maintained at hydrocarbon conversion conditions and producing a mixed phased reaction zone effluent stream comprising hydrogen, light hydrocarbons and hydrocarbons boiling above 150° C.; cooling the reaction zone effluent stream by indirect heat exchange against the feed stream in a first heat exchanger located at a point located upstream of the fired heater and dividing the reaction zone effluent stream into a minor portion and a major portion; cooling the major portion of the reaction zone effluent stream by indirect heat exchange against a liquid phase first process stream in a second heat exchanger; cooling the major portion of the reaction zone effluent stream by indirect heat exchange against the feed stream in a third heat exchanger at a point located upstream of the fired heater; cooling the major portion of the reaction zone effluent stream by indirect heat exchange against a recycle gas stream, which is subsequently admixed into the feed stream; recombining the major and minor portions of the reaction zone effluent stream; cooling the reaction zone effluent steam by generating steam; cooling the reaction zone effluent stream by indirect heat exchange against the first process stream in a fourth heat exchanger; further cooling and partially condensing the reaction zone effluent steam and passing the reaction zone effluent stream into a vapor-liquid separation zone which produces the first process stream; passing the first process stream into an intermediate portion of a fractionation column operated at conditions effective to separate the entering hydrocarbons into a net overhead stream comprising naphtha boiling range hydrocarbons and a net bottoms stream comprising diesel boiling range hydrocarbons; and, cooling the net bottoms stream by indirect heat exchange against the first process stream in a fifth heat exchanger located intermediate the second and fourth heat exchangers, and removing the net bottoms stream as a product stream.

What is claimed:

1. A hydrocarbon conversion process which comprises the steps of:

a. passing a feed stream having an initial boiling point above 150° C. into a reaction zone maintained at hydrocarbon conversion conditions and producing a mixed phased reaction zone effluent stream comprising hydrogen, light hydrocarbons and hydrocarbons boiling above 150° C.;

b. cooling the reaction zone effluent stream by indirect heat exchange against the feed stream in a first heat exchanger;

c. cooling the reaction zone effluent stream by indirect heat exchange against a first process stream in a second heat exchanger;

d. cooling the reaction zone effluent stream by indirect heat exchange against the feed stream in a third heat exchanger;

e. further cooling and partially condensing the reaction zone effluent stream and passing the reaction zone effluent stream into a vapor-liquid separation zone which produces the first process stream; and, f. passing the first process stream into an intermediate portion of a fractionation column operated at conditions effective to separate entering hydrocarbons into a net overhead stream comprising naphtha boiling range hydrocarbons and a net bottoms stream comprising diesel boiling range hydrocarbons and removing the net bottoms stream as a product stream.

2. The process of claim 1 wherein the net bottoms stream is also cooled by indirect heat exchange against the first process stream in a fourth heat exchanger located intermediate the second and third heat exchangers.

3. The process of claim 1 further characterized in that the reaction zone effluent stream is also cooled by indirect heat exchange against the feed stream in an additional indirect heat exchange step performed between steps (c) and (d).

4. A hydrocarbon conversion process which comprises the steps of:

a. heating a feed stream having an initial boiling point above 150° C. in a fired heater, passing the heated feed stream into a reaction zone maintained at hydrocarbon conversion conditions and producing a mixed phased reaction zone effluent stream comprising hydrogen, light hydrocarbons and hydrocarbons boiling above 150° C.;

b. cooling the reaction zone effluent stream by indirect heat exchange against the feed stream in a first heat exchanger located at a point located upstream of the fired heater;

c. cooling the reaction zone effluent stream by indirect heat exchange against a liquid phase first process stream in a second heat exchanger;

d. cooling the reaction zone effluent stream by indirect heat exchange against the feed stream in a third heat exchanger at a point located upstream of the fired heater;

e. cooling the reaction zone effluent stream by indirect heat exchange against the first process stream in a fourth heat exchanger;

f. further cooling and partially condensing the reaction zone effluent stream and passing the reaction zone effluent stream into a vapor-liquid separation zone which produces the first process stream;

g. passing the first process stream into an intermediate portion of a fractionation column operated at conditions effective to separate the entering hydrocarbons into a net overhead stream comprising naphtha boiling range hydrocarbons and a net bottoms stream comprising diesel boiling range hydrocarbons; and, h. cooling the net bottoms stream by indirect heat exchange against the first process stream in a fifth heat exchanger located intermediate the second and fourth heat exchangers, and removing the net bottoms stream as a product stream.

5. A hydrotreating conversion process which comprises the steps of:

a. heating a feed stream having an initial boiling point above 150° C. in a fired heater, passing the feed stream into a hydrotreating reaction zone maintained at hydrocarbon conversion conditions and producing a mixed phased reaction zone effluent stream comprising hydrogen, light hydrocarbons and hydrocarbons boiling above 150° C.;

b. cooling the reaction zone effluent stream by indirect heat exchange against the feed stream in a first heat exchanger located at a point located upstream of the fired heater, and then dividing the reaction zone effluent stream into a minor portion and a major portion;

c. cooling the major portion of the reaction zone effluent stream by indirect heat exchange against a liquid phase first process stream in a second heat exchanger;

d. cooling the major portion of the reaction zone effluent stream by indirect heat exchange against the feed stream in a third heat exchanger at a point located upstream of the fired heater;

e. cooling the major portion of the reaction zone effluent stream by indirect heat exchange against a recycle gas stream, which is subsequently admixed into the feed stream;

f. recombining the major and minor portions of the reaction zone effluent stream;

g. cooling the reaction zone effluent stream by indirect heat exchange against the first process stream in a fourth heat exchanger;

h. further cooling and partially condensing the reaction zone effluent stream and passing the reaction zone effluent stream into a vapor-liquid separation zone which produces the first process stream and the recycle gas stream;

i. passing the first process stream into an intermediate portion of a fractionation column operated at conditions effective to separate the entering hydrocarbons into a net overhead stream comprising naphtha boiling range hydrocarbons and a net bottoms stream comprising diesel boiling range hydrocarbons; and, j. cooling the net bottoms stream by indirect heat exchange against the first process stream in a fifth heat exchanger located intermediate the second and fourth heat exchangers, and removing the net bottoms stream as a product stream.

6. The process of claim 5 further characterized in that the third heat exchanger is located upstream, relative to the feed stream, of the second heat exchanger.

7. The process of claim 5 further characterized in that the reaction zone effluent stream is cooled by indirect heat exchange which generates steam between steps (f) and (g).

8. The process of claim 5 further characterized in that the vapor-liquid separation zone comprises two separate vapor liquid separation vessels, with the vapor removed from a first vessel being cooled and passed into the second vessel, and with the first process stream being formed by combining liquid removed from both vessels.

* * * * *